United States Patent [19]

Davidson

[11] 4,267,666

[45] May 19, 1981

[54] SHIELD FOR A WINDOW

[76] Inventor: James D. Davidson, 2003 Lansing St., Portage, Mich. 49081

[21] Appl. No.: 39,449

[22] Filed: May 16, 1979

Related U.S. Application Data

[63] Continuation of Ser. No. 912,186, Jun. 5, 1978, abandoned, which is a continuation of Ser. No. 776,488, Mar. 10, 1977, abandoned.

[51] Int. Cl.[3] ..... E05C 7/02

[52] U.S. Cl. ..... 49/63; 49/370; 49/372; 49/449

[58] Field of Search ..... 49/63, 372, 370, 449, 49/425; 160/37, 90, 91, 202

[56] References Cited

U.S. PATENT DOCUMENTS

| | | | |
|---|---|---|---|
| 1,612,249 | 12/1926 | Anderson | 49/370 |
| 2,637,265 | 5/1953 | Emmert | 49/61 X |
| 2,699,204 | 1/1955 | Davis | 49/63 X |
| 3,863,621 | 2/1975 | Schoenfelder | 237/1 A |

FOREIGN PATENT DOCUMENTS

| | | | |
|---|---|---|---|
| 833992 | 5/1960 | United Kingdom | 49/63 |

*Primary Examiner*—Kenneth Downey
*Attorney, Agent, or Firm*—Blanchard, Flynn, Thiel, Boutell & Tanis

[57] ABSTRACT

A device for use in combination with a window unit including a window frame and glass panels mounted in the window frame. The device is comprised of a shutter unit having one or more sets of horizontally and parallel extending tracks which are vertically spaced a distance at least equal to the height dimension of the window unit. The tracks extend parallel to the plane of the glass panel and beyond at least one of the side edges of the window unit. A laminate insulative shield is mounted in the track for movement between positions at the side of the window unit and in front thereof to block off the entirety of the glass panel. The laminate insulative shield includes a frame movably supported on the track and has an imperforate surface layer and an insulation material layer mounted side-by-side in the frame. The imperforate surface provides a rigidifying support for the rather fragile insulation material. A seal structure is provided for effecting a seal around the periphery of the glass panel and between the window unit and the insulative shield.

10 Claims, 17 Drawing Figures

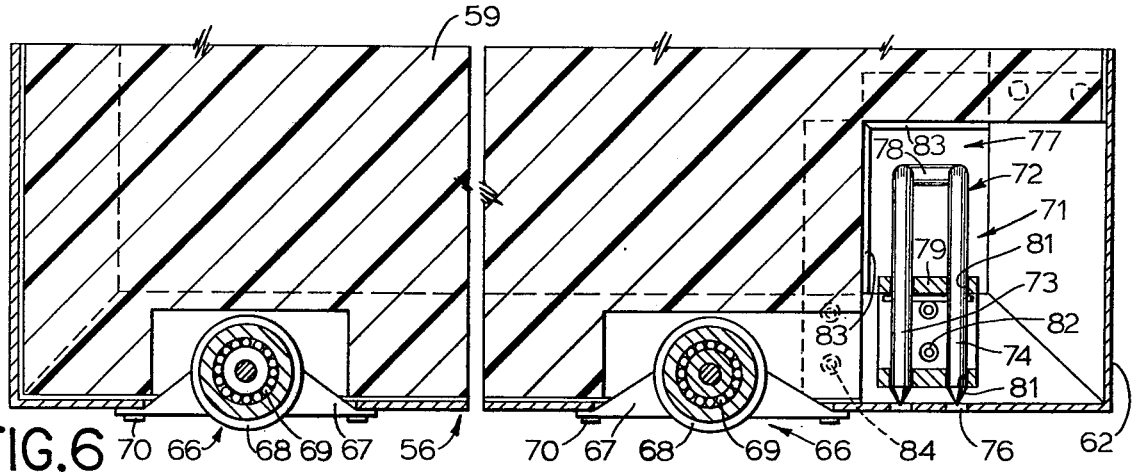
FIG.6
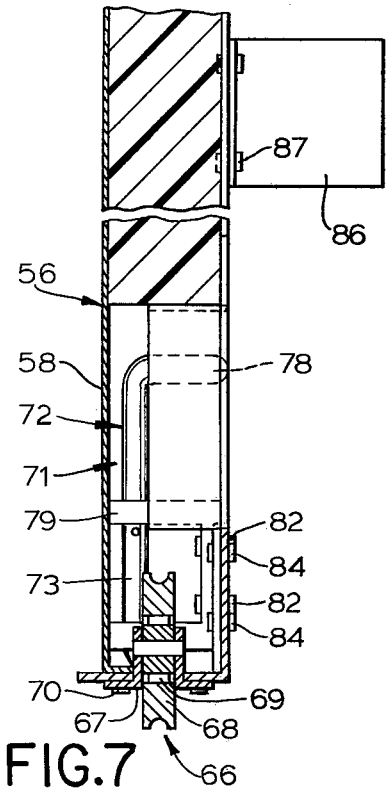
FIG.7
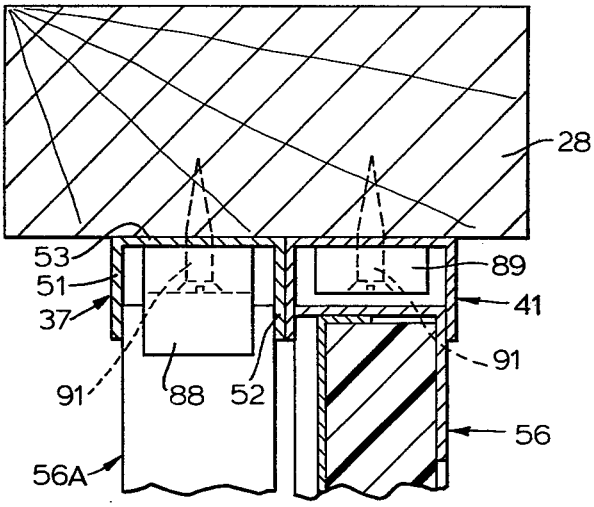
FIG.9
FIG.8
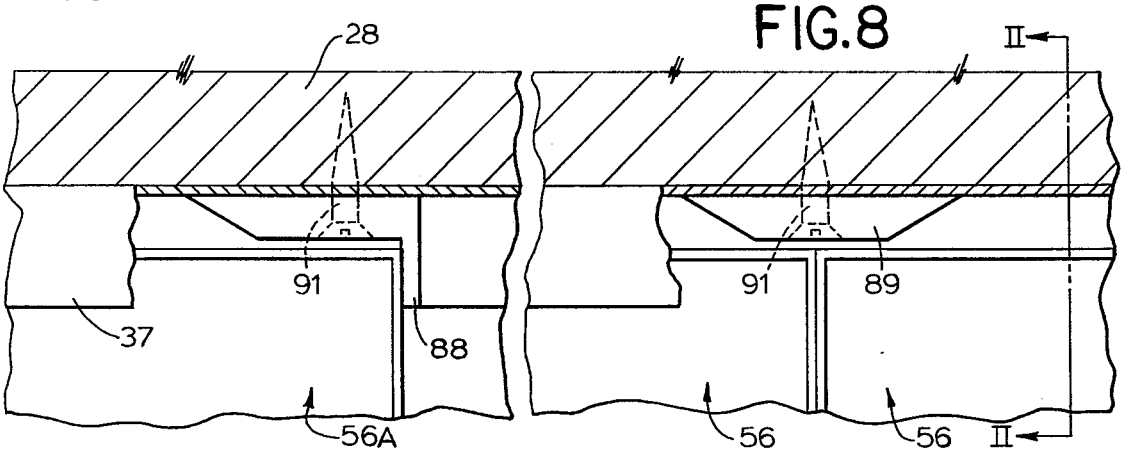

SHIELD FOR A WINDOW

This application is a continuation of application Ser. No. 912,186, filed June 5, 1978, which, in turn, is a continuation application of Ser. No. 776,488, filed Mar. 10, 1977, both applications having now been abandoned.

FIELD OF THE INVENTION

This invention relates to a shutter unit for use in combination with a window unit and, more particularly, relates to a laminate insulative shield that is comprised of both an imperforate surface layer and an insulation material layer mounted side-by-side on a frame, which imperforate surface layer provides a rigidifying support for the insulation material layer and also provides a barrier to prevent unauthorized entry when the insulative shield is positioned in front of the window unit.

BACKGROUND OF THE INVENTION

Shutter units of many kinds and constructions are known in the art. One example of such shutter constructions are disclosed in Boyden & Warren U.S. Pat. No. 196,186. In addition, there is also known an interior type of shutter construction as illustrated in Shellman, Sr. et al Pat. No. 3,496,675. While these devices do disclose the use of solid panels to bar inclement weather, these devices are not effective for minimizing heat transfer therethrough to enable a building incorporating such structures therein to conserve a maximum of energy.

Accordingly, it is an object of this invention to provide a shutter unit for use in combination with a window unit, which shutter unit has the capability of minimizing heat transfer therethrough while simultaneously offering a rather substantial barrier against unauthorized entry.

It is a further object of this invention to provide a shutter unit for use in combination with a window unit, as aforesaid, wherein insulation material is utilized as the means by which the heat transfer therethrough is minimized.

It is a further object of this invention to provide a shutter unit, as aforesaid, wherein the insulation material, which has a rather fragile characteristic, is rigidified by a barrier surface, which barrier surface prevents unauthorized entry.

It is a further object of this invention to provide a shutter unit which is capable of preassembly at the factory for installation into the building during construction and/or after the building has been completed.

It is a further object of this invention to provide a shutter unit wherein the insulative shield member is incapable of removal from the support therefor while the insulative shield is in blocking relation with respect to the window unit.

It is a further object of this invention to provide a shutter unit which is appealing in appearance when in the closed position in front of the window unit and is durable in construction and maintenance free.

SUMMARY OF THE INVENTION

In general, the objects and purposes of the invention are met by providing a shutter unit which has one or more sets of horizontally and parallel extending tracks vertically spaced a height equal to the vertical height dimension of a window unit. The tracks extend parallel to the plane of the glass panel and beyond at least one side edge thereof. A laminate insulative shield is mounted in the track for movement between positions at the side of the window unit and in front thereof to block off the entirety of the glass panel means. The laminated insulative shield includes a frame movably supported on the track and has an imperforate surface layer and an insulation layer mounted side-by-side in the frame. A seal is provided for effecting a seal around the periphery of the glass panel means and between the window unit and the insulative shield.

BRIEF DESCRIPTION OF THE DRAWINGS

Further objects and purposes of this invention will be apparent to persons acquainted with apparatus of this general type upon reading the following specification and inspecting the accompanying drawings, in which:

In the drawings:

FIG. 6 is a sectional view through an insulative panel;

FIG. 7 is a sectional view taken along the line VII—VII of FIG. 6;

FIG. 8 is a fragment of the upper portion of the shutter unit when the insulative panels are in the closed position as illustrated in FIG. 3;

FIG. 9 is a sectional view taken along the line IX—IX of FIG. 8;

DETAILED DESCRIPTION

Figure 1:
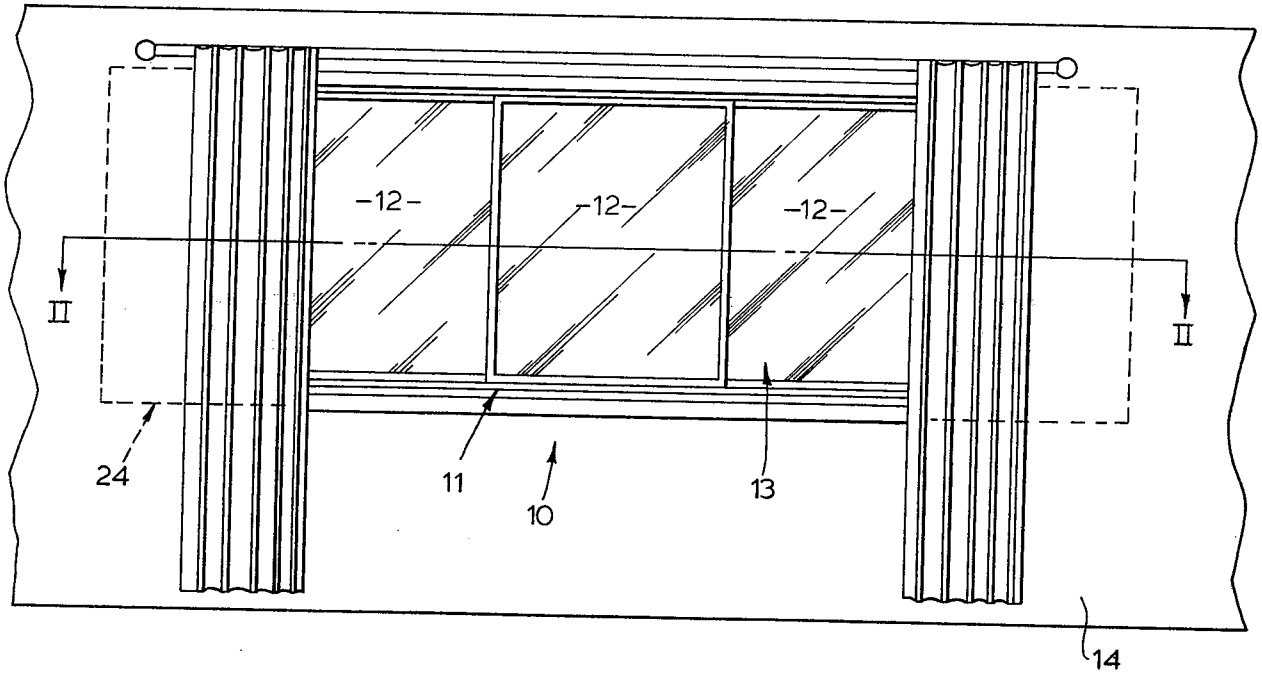
FIG. 1 is a front elevational view of a window unit having a shutter unit embodying the invention associated therewith.
Figure 5:
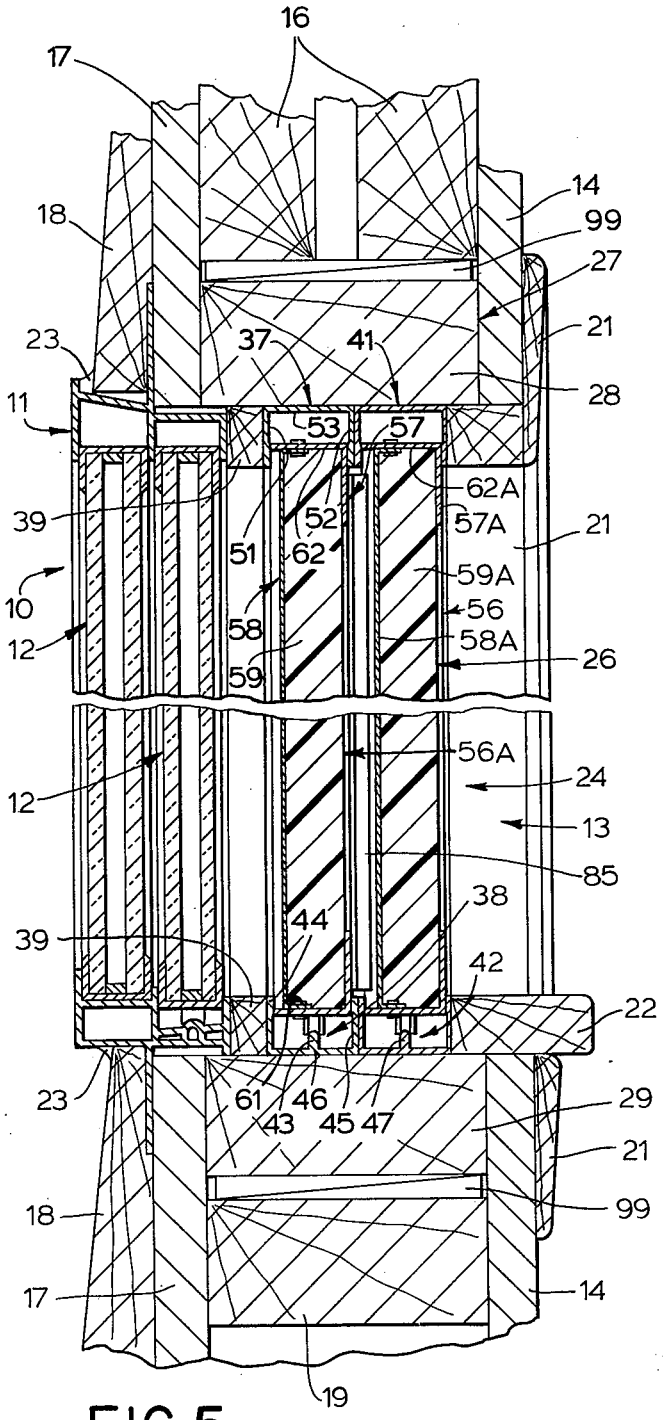
FIG. 5 is a central sectional view through a shutter unit in a window opening wherein the shutter unit has a pair of side-by-side tracks associated therewith.

A window unit 10 is illustrated in FIG. 1 and comprises a conventional window frame 11 having one or a plurality of glass panels 12 either fixed or movable relative with respect to one another mounted therein. The window frame 11 is mounted in a window opening 13 in the wall 14 of a building. The wall 14 of the building has the usual header beams 16 over the top of the window opening 13. The external surface of the building has the usual sheathing 17 and outside siding 18. The wall 14 also has the usual frame sill 19 and decorative trim structure 21 and stool 22 around the inside of the window opening 13. In addition, caulking 23 is provided between the window frame 11 and the outside siding 18 as illustrated in FIG. 5. It is to be understood that the window unit 10 illustrated in the drawings is for illustrative purposes only and no invention resides in the specific structure thereof.

Figure 2:
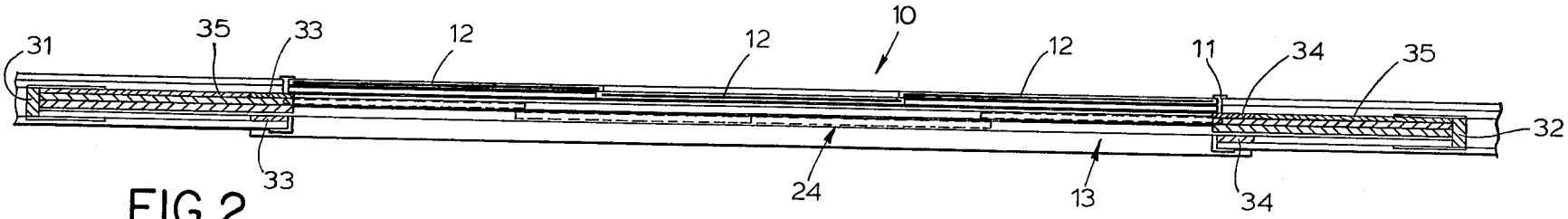
FIG. 2 is a sectional view taken along the line II—II of FIG. 1.

My invention resides in the provision of a shutter unit 24 which is mounted in close proximity and encircling relation with respect to the window unit 10. The shutter unit 24 has one or more insulative shield units 26 mounted on a track frame 27. The number of insulative shield units is controlled by the width of the window unit 10. More specifically, the track frame 27 (FIG. 3) is composed of an upper frame member 28 and a lower frame member 29 vertically spaced from the upper frame member 28, which vertical spacing is maintained by a pair of end frame members 31 and 32 secured to the remote ends of the upper and lower frame members 28 and 29. Intermediate inside and outside frame members 33 and 34 are provided between the end frame members 31 and 32, but spaced a distance slightly greater than the window opening 13. A sheet of insulation material made of polyurethane is provided between the end frame member 31 and the outside one of the intermediate frame members 33 as well as between the end frame member 32 and the outside one of the intermediate frame members 34 as illustrated in FIG. 2. The length of the track frame 27 is longer than the width of the window unit to provide storage for panels discussed below at one or both sides of the glass panel 12. A plurality of gussets are utilized for rigidifying the track frame 27 in the corners between the upper and lower frame members 28 and 29 and each of the frame members 31, 32, 33 and 34. The inside to outside spacing and the section of the track frame 27 at one or both sides of the opening defined by the upper and lower frame members 28 and 29 and the intermediate frame members 31, 32, 33 and 34 define pockets.

Figure 4:
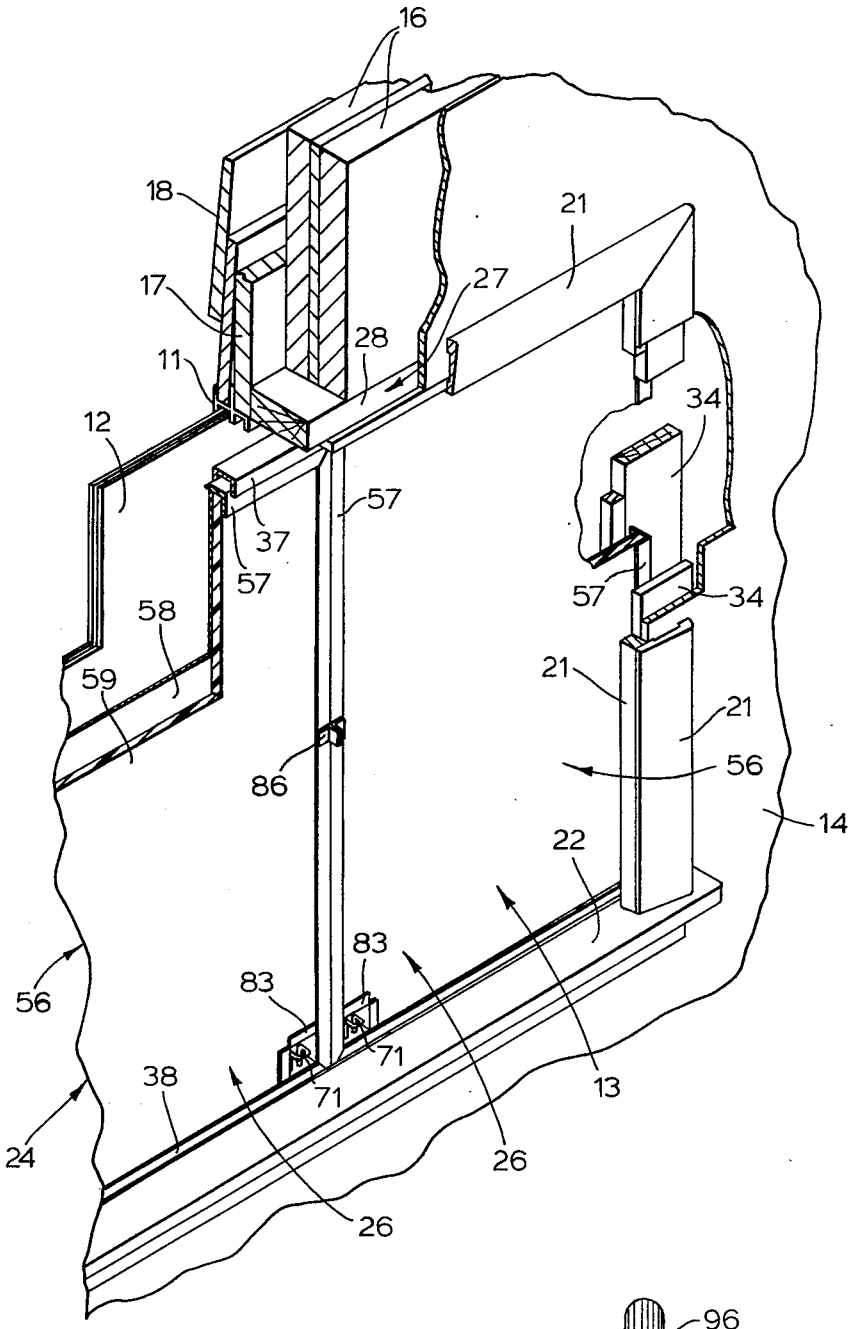
FIG. 4 is a perspective view of the shutter unit embodying the invention and having a pair of cooperating insulative panels in the closed position across the window unit.

The track frame 27 includes a first set of tracks consisting of an upper track 37 and a lower track 38. A single track shutter unit 24 is illustrated in FIG. 4. A double track shutter unit 24 is illustrated in FIG. 5 wherein the track frame has a second set of tracks consisting of an upper track 41 and a lower track 42 extending parallel to the first set of tracks 37 and 38. The first set of tracks, particularly the lower track 38 has a pair of parallel upstanding side walls 44 and 45 (FIG. 5) thereon with a bight portion 46 interconnecting said side walls along the bottom edge thereof. An upwardly projecting rail 43 is centrally disposed on the bight portion 46. The track 42 is identical to the track 38 and has an upstanding rail 47 centrally disposed therein. The upper track 37 has a pair of parallel side walls 51 and 52 with an interconnecting bight portion 53. The upper track 41 is identical to the upper track 37.

The insulative shield unit 26 includes at least one insulated panel 56 mounted on the pair or tracks 37 and 38. In the embodiment illustrated in FIG. 4, a pair of insulated panels 56 are provided. Each insulated panel 56 consists of an annular rectangular frame 57 wherein the edges have an L-shaped cross section and the upper and lower edges of the frame 57 are guided in the upper and lower tracks 37 and 38, respectively. A sheet of insulation material 59 is disposed in the L-shaped frame 57 and an imperforate sheet or metal panel 58 is placed thereover and riveted to the leg 62 of the frame by the rivet 61 so as to fixedly secure the insulation material in the frame 57. The insulation material 59 is preferably a polyurethane composition which is rather fragile when forces perpendicular to the plane thereof are applied thereto. However, the imperforate sheet or metal panel 58 serves to rigidly back the insulation material 59 while simultaneously functioning as a barrier to prevent unauthorized movement through the window opening when the insulated panels 56 are in the closed position as will be explained in more detail below.

Figure 3:
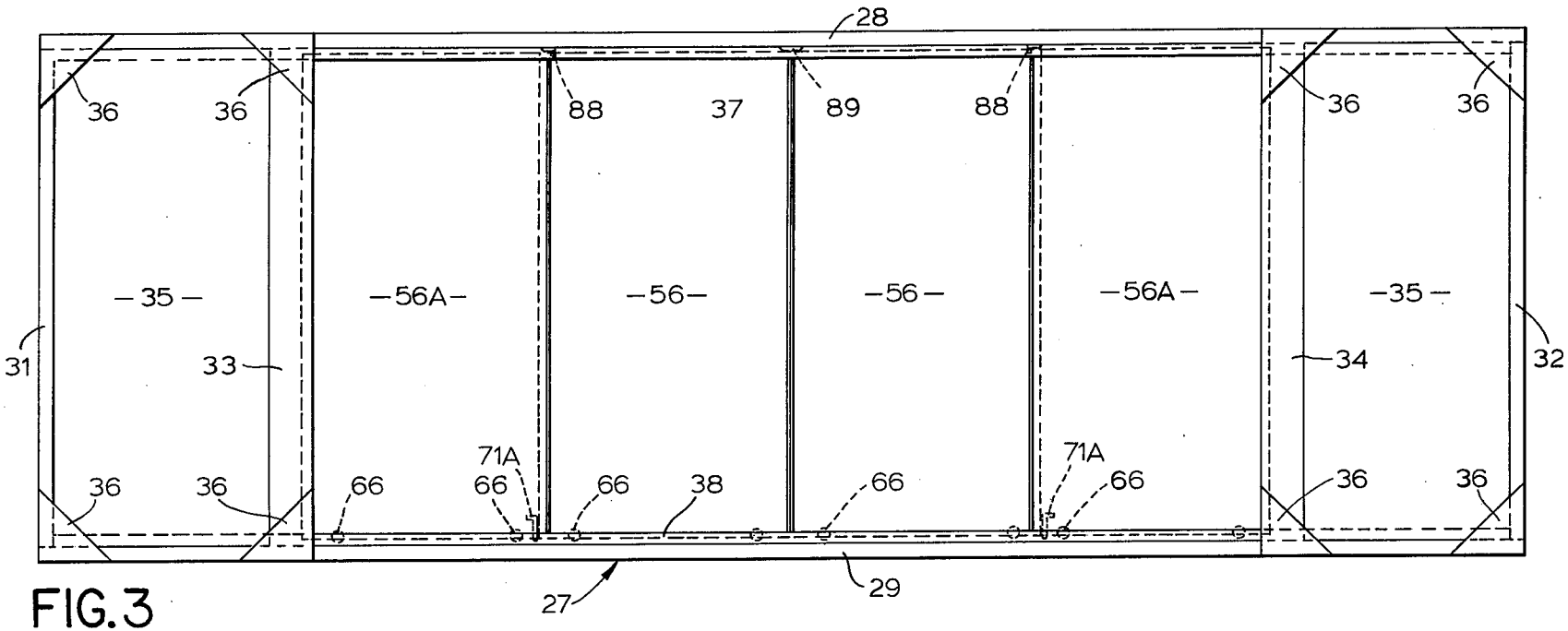
FIG. 3 is a front elevational view of a track frame for the shutter unit.

The lower edge of the frame 57 of each insulated panel 56 has an opening therethrough and a roller assembly 66 is mounted in the opening as illustrated in broken lines in FIG. 3. The rollers are adapted to engage the rail 43 in the lower track 38. The roller assembly 66 includes a bracket 67 (FIG. 6) riveted to the frame 57 by rivets 70. A wheel 68 is rotatably supported on bearings 69 secured to the bracket 57. In this particular embodiment of FIGS. 3 and 6, two such roller assemblies 66 are provided on the insulated panels 56. The insulated panel 56A (FIG. 5) is spaced inwardly from the panel 56 and is identical in construction to the insulated panel 56. Corresponding reference numerals have been utilized to identify identical parts throughout this disclosure but with the suffix "A" added thereto.

The horizontal leg 62 of the frame 57 has a length which corresponds to the horizontal spacing between the legs 51 and 52 of the upper track 37 and the legs 44 and 45 of the lower track 38. As a result, and in view of the occupancy of the entire width of the tracks 37 and 38 by the leg 62, an effective sliding seal is provided thereat.

A lock mechanism 71 is mounted on each of the insulated panels and one such embodiment is illustrated in FIGS. 6 and 7. The lock mechanism 71 comprises a pin device 72 having a pair of parallel downwardly extending legs 73 and 74. The pin device 72 is guided in a guide 79 and the legs 73 and 74 are received is guide holes 81 therein. The lock mechanism 71 is mounted in an opening 77 in the insulation material 59 and the guide member 79 is secured to the vertically extending leg part of frame 57 by rivets 82. In view of the fragility of the insulation material 59, angled frame pieces 83 are provided around the opening 77 and are secured to the frame 57 by rivets 84 to protect the edges of the insulation material.

One side edge of the insulative panel 56 which constitutes the leading edge thereof has a tab 86 (FIGS. 7 and 12) secured to the frame 57 by rivets 87. The tab 86 is also illustrated in FIG. 4. In the embodiment of FIG. 4, two insulative panels are provided in the tracks 37 and 38 and move toward and away from each other between positions at the side of the window opening 13 and in front thereof so as to block the entirety of the glass panel. The leading edge of each of the insulated panels 56 has the tab 86 thereon which can be gripped for drawing the panels toward one another to the blocking position across the glass panels. In the closed position, illustrated in FIG. 4, for example, holes 76 are provided in the frame 57 and corresponding holes are also provided in the lower track 38 to facilitate reception of the legs 73 and 74 of the pin device 72 of the lock mechanism 71 to lock the panels 56 in the closed position.

Figure 11:
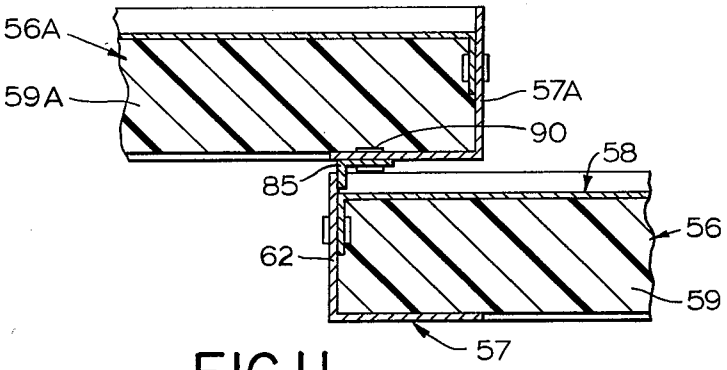
FIG. 11 is a fragment of the connection and seal between a pair of insulative panels in the closed position in front of the window.

When a plurality of panels are provided on a pair of horizontal and parallel extending upper and lower tracks, such as the track sets 37,38 and 41,42 illustrated in FIG. 5, a modified lock mechanism 71A (FIG. 3) can be utilized adjacent the trailing edge of the frontmost panel 56. As a result, when the legs of the lock mechanism 71 are properly engaged with corresponding holes provided in the lower track 38, the two panels that are centrally disposed in the illustration of FIG. 3 cannot be opened. Similarly, the two laterally outer panels 56A which straddle the innermost panels 56 likewise cannot be moved relative to the tracks 37,38 and 41,42. That is, a movement of the panels 56A toward one another or, and referring to FIG. 11, the panel 56A to the right is prevented by a cam stop 88 which is secured to the upper track 37 as illustrated in FIG. 9 by a screw 91. The same is true for the panel 56 on the other side of the window opening. A movement of the panel 56A (FIG. 11) to the left is prevented by engagement of an L-shaped rail 85 secured to the frame 57A thereof by a rivet 90 with the edge of the leg 62 of the frame 57 of the next adjacent panel 56. This engagement also defines a seal. Similarly, a cam 89 is provided above the junction at the center of the window unit between the two adjacent panels 56. The cam 89 is secured to the upper track 41 by a screw 91 whereas the cam stops 88 are secured to the upper track 37. The cam 89 will prevent a lifting of the central two panels 56 upwardly out of the lower track 38. The cam stop 88 also prevents a lifting of the two outermost panels 56A out of the lower track 38.

Figure 10:
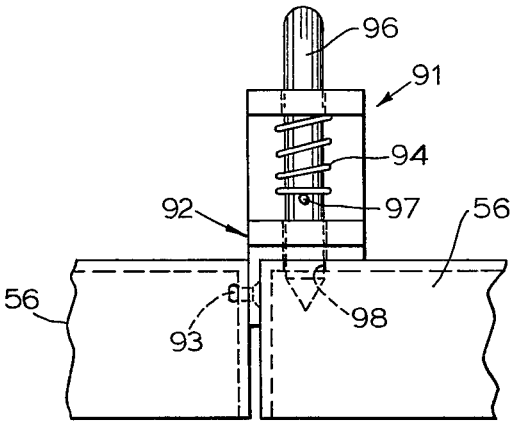
FIG. 10 is a fragmentary illustration of a modified locking mechanism.

A modified lock mechanism 91 is illustrated in FIG. 10. The modified lock mechanism 91 consists of a bracket 92 which is secured to one insulated panel 56 by a rivet 93. The bracket 92 projects away from one panel 56 and extends coextensive with and alongside another panel 56 having a hole 98 in the frame thereof. A pin device 96 is reciprocally mounted in the bracket 92 and a spring extends between a leg on the bracket 92 and a cross pin 97 secured to the pin device 96. The free end of the pin device 96 is received into the hole 98 in the frame of the next adjacent panel 56 when the pin and hole are in alignment. As a result, when the two mutually adjacent panels occupying the same set of upper and lower tracks 37,38, such as is illustrated in FIG. 4, the lock mechanism 91 can be utilized to secure the two panels together. The modified lock mechanism 91 can be used, if desired, in addition to the lock mechanism 71.

During assembly of the track frame 27 into the wall of a building under construction, the track frame 27 is mounted on the frame sill 19 so that the track frame 27 is positioned between the frame sill 19 and the header beams 16. If desired, shims 99 can be utilized to properly locate the track frame relative to the window opening 13, particularly the window frame mounted therein. In addition, and if desired, a trim strip 39 can be provided between the upper and lower tracks 37 and 38, respectively, and the inside portion of the window frame 11. The trim 21 on the inwardly facing side of the track frame 27 can also be selected to correspond to the thickness of the inside wall 14 between the track frame 27 and the other inner trim 21 encircling the window opening.

Referring in more detail to the characteristics of the insulation material 59 and the insulation material 35, it is presently contemplated to utilize sheets of polyurethane as stated above. The sheets of polyurethane are preferably in the range of one-half inch to one inch thick and have an insulation "R" factor in the range of between 3 and 8. When only one panel exists for blocking the entirety of the glass panel, the panel 56 will be sealed at the tracks 37 and 38 as discussed above as well as at the lateral edges as a result of an abutment of the one edge of the panel with one side wall of the window opening and with a flange on the frame 57 coming into contact with a stop provided on the other side edge of the window opening.

Figure 12:
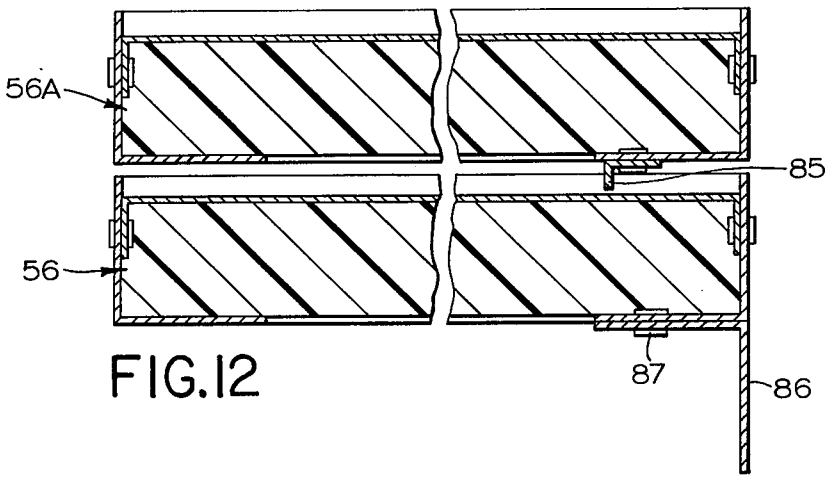
FIG. 12 is a fragment of the insulative panels in the stored position at one side of the window unit.

If desired, the tracks 37,38 and 41,42 can extend beyond the laterally opposite edges of the window unit into a pair of pockets on opposite sides of the window. In this construction, the number of panels can be divided so that one-half will be received into one pocket for storage and the other half will be received into the other pocket for storage. FIG. 12 shows in larger detail the panels 56 and 56A in side-by-side storage. By manually engaging the tabs, the panels may be drawn one after the other out of the respective pockets to a central position such as is illustrated in FIG. 3. The cooperating flanges and frame construction will permit the panels to move one after the other toward the closed position. Similarly, a movement of the panels to the open position will effect a cooperation between the rail 85 and the frame 57 so that the panels will telescope back into the respective pockets at the side edges of the window unit.

ALTERNATE CONSTRUCTIONS

When it is desired to utilize my invention in association with buildings that have already been constructed, it will not be conveniently possible to provide pockets for the insulated panels at the side edge of the window units. However, I have provided a modified construction for cooperation with window units such as is illustrated in FIGS. 13 to 16. In this particular embodiment, I have illustrated a slightly different window construction 110 having a window frame 111 with glass panels 112 mounted in the window opening 113. The window frame 111 is mounted in the wall 114. Conventional header beams 116 are provided over the top of the window opening 113 and conventional sheathing 117 and outside siding 118 and trim 119 are provided in the usual manner. In addition, decorative trim 121 is provided on the inside of the building encircling the window opening and the window has the usual stool 122 provided thereon.

I have developed a modified track frame 126 which includes upper and lower brackets 127 and 128, respectively, the upper bracket being secured to the wall 114 by screws 129 and the lower bracket being secured to the inside edge, for example, of the stool 122 by screws 131. The bracket 127 includes an inverted U-shaped trough 132 which has downwardly extending parallel legs 133 and 134 connected by a bight portion 135, which bight portion 135 is secured by a bolt assembly 136 to the bracket 127. Similarly, a lower U-shaped trough 137 is provided and has a pair of upstanding parallel legs 138 and 139 interconnected by a bight portion 140, which bight portion 140 is secured by a bolt assembly 141 to the bracket 128.

Figure 14:
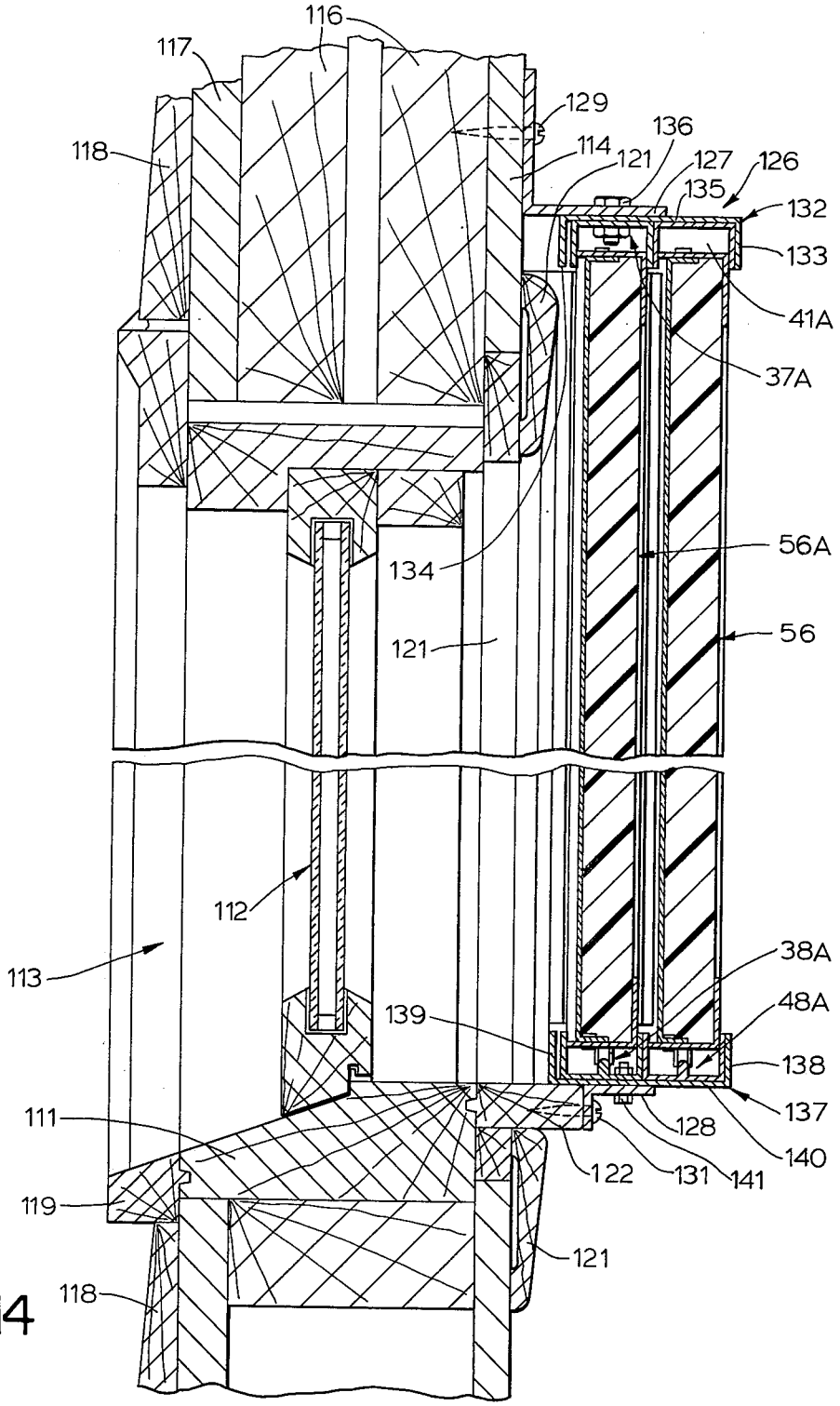
FIG. 14 is a sectional view taken along the line XIV—XIV in FIG. 11.
Figure 15:
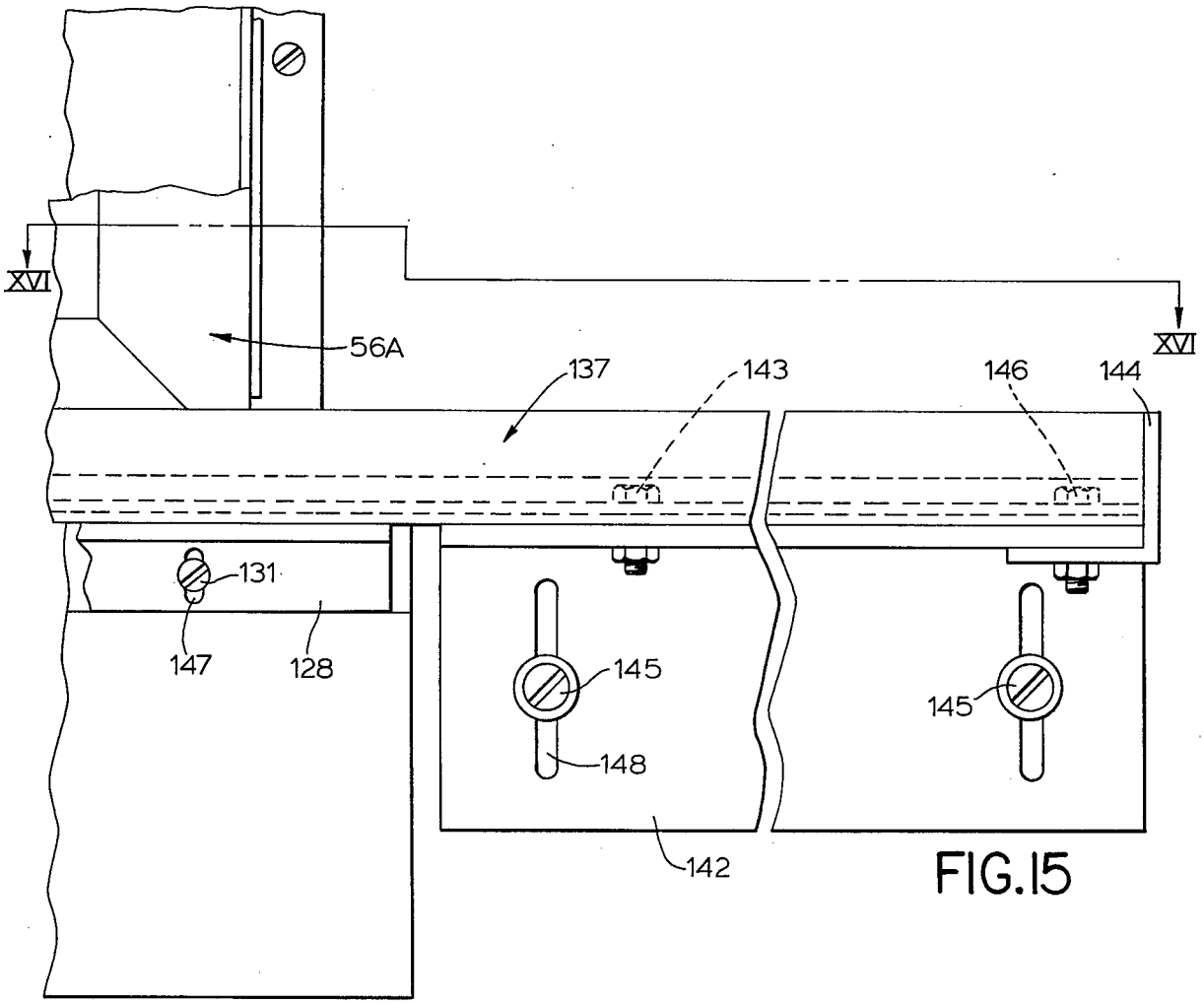
FIG. 15 is an enlarged illustration of a fragment of FIG. 11.
Figure 16:
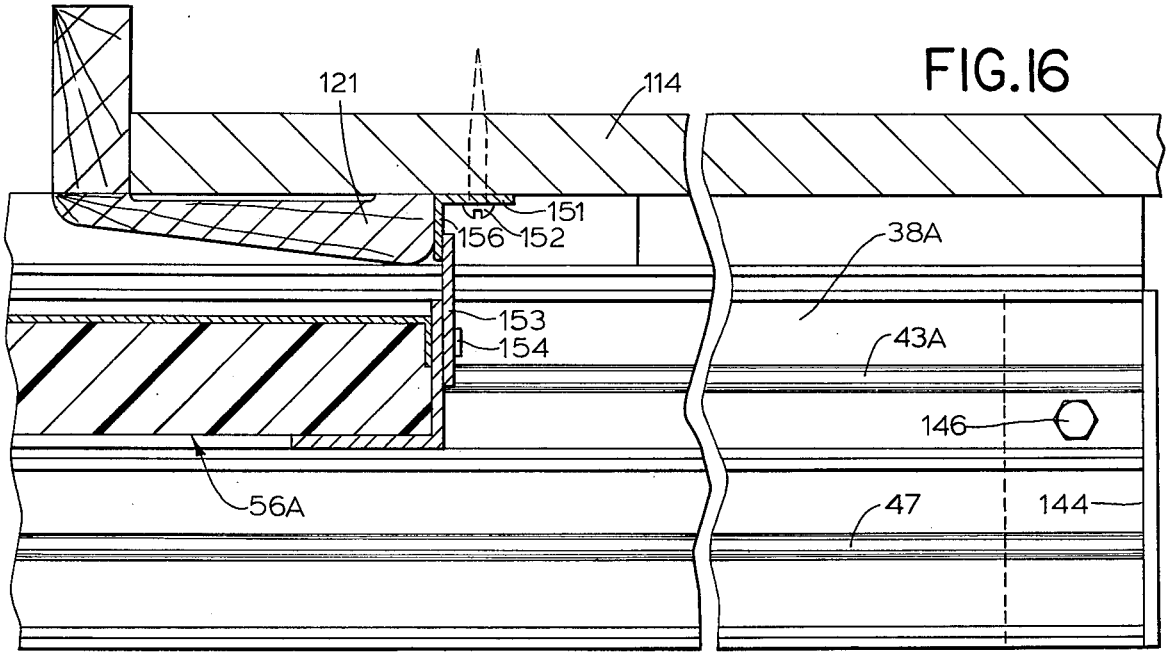
FIG. 16 is a sectional view taken along the line XVI—XVI in FIG. 13.

In the embodiment which I have illustrated in FIG. 14, for example, I have provided a pair of upper and lower sets of tracks, 37A,38A and 41A,42A which are identical in cross section to the tracks 37,38 and 41,42 illustrated in the preceding discussed embodiment. Accordingly, further comment about the cross-sectional shape of the tracks is believed to be unnecessary. In addition, insulated panels 56 and 56A are slidably disposed in the tracks in a manner which has been described hereinabove and in association with the embodiment illustrated in FIG. 5. Accordingly, it is believed that based upon the preceding discussion that the cooperation between the insulated panels and the tracks will be appreciated.

Figure 13:
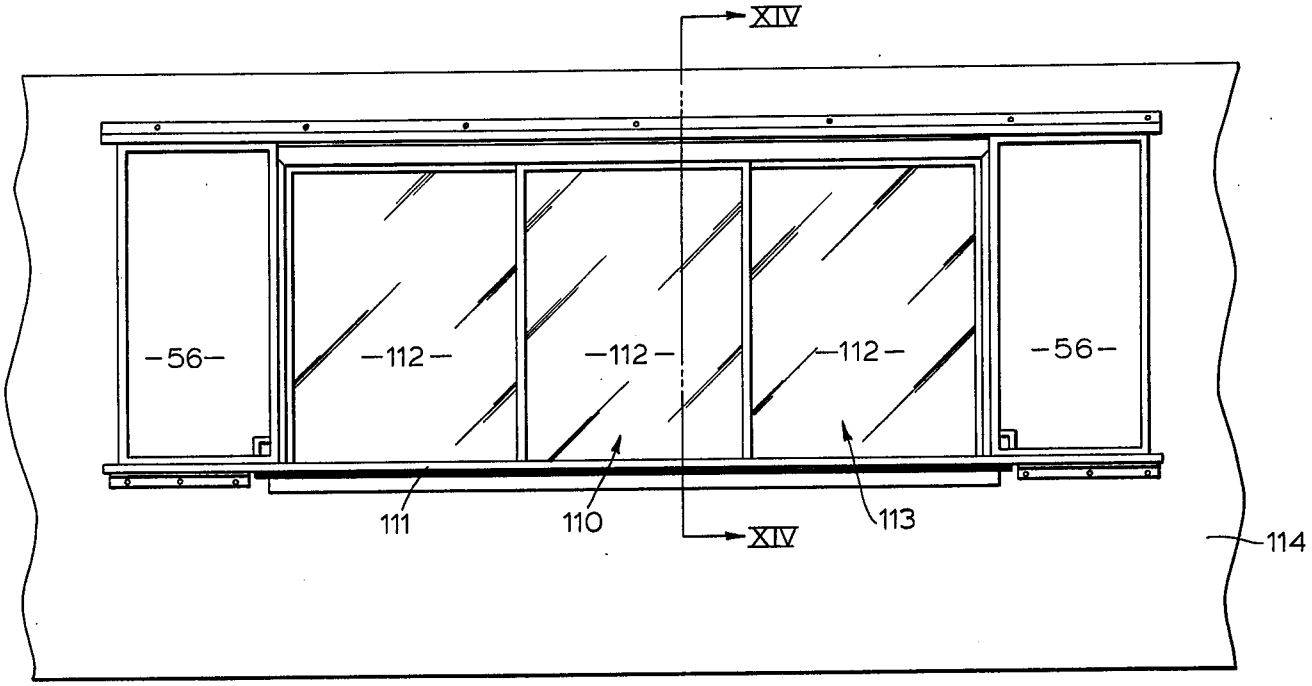
FIG. 13 is a front elevational view of a modified form of the invention.

As with the preceding embodiment, the upper and lower sets of tracks extend laterally beyond the side edges of the window opening 113 as illustrated in FIG. 13. The lateral ends of the lower track each have a bracket 142 thereon which is secured to the wall 114 by screws 145. The bracket 142 is adjustable relative to the lower U-shaped trough 137 so that the difference in spacing between the track and the forward edge of the stool 122 and the plane of the wall 114 can be compensated for by the bracket 142. The bolt assembly 143 can be utilized to facilitate this adjustment. A stop 144 is provided at the lateral ends of the lower track 38A and 42A and are secured to the lower U-shaped trough 137 by a bolt assembly 146. The stop 144 will limit the lateral travel of the panels on the tracks in the stored position. A vertical adjustment of the lower track is permitted by slots 147 and 148 in the brackets 128 and 142. A loosening of the screws 131 and 145 will facilitate a vertical movement of the lower track to facilitate a proper spacing between the upper and lower tracks to accommodate the insulated panel 56 therebetween.

The trailing panel 56A (FIG. 16) has a flange 153 secured thereto by a rivet 154. In addition, an L-shaped bracket 151 is secured to the wall 114 by a screw 152. One leg 156 of the bracket 151 projects into the pathway of the flange 153 to prevent further leftward movement of the panel 56A relative to the track 38A.

Figure 17:
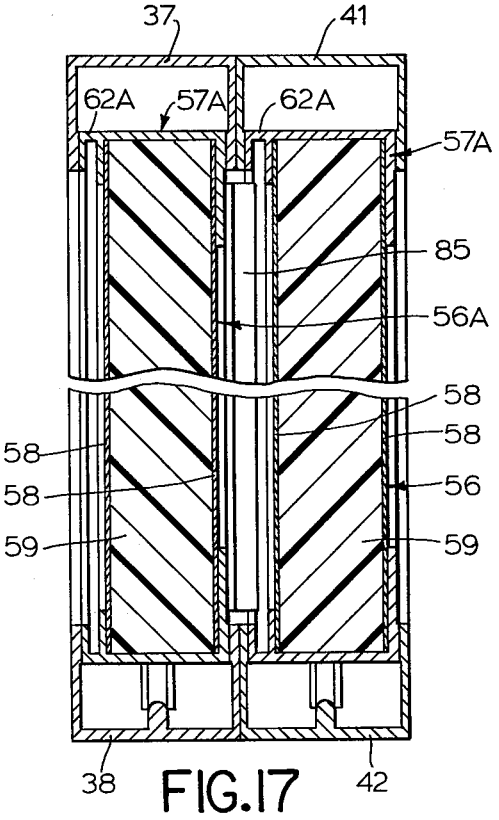
FIG. 17 is a sectional view illustrating a modified frame construction.

FIG. 17 illustrates a modified panel construction. The upper and lower sets of tracks 37,38 and 41,42 are identical to the track structure described hereinabove and no further comment is believed necessary. However, the frame surrounding the panels 56 and 56A is modified so that the side members thereof have a profile enabling it to be made of an extruded metal. The extruded component is then cut to define an annular frame surrounding the polyurethane insulation material 59. In this particular embodiment, a pair of imperforate panels 58 are provided on opposite sides of each of the sections of insulation material 59. An L-shaped rail 85 is secured by rivets or other means to the frame components 57A at generally the same location as has been described above with the preceding embodiment. The L-shaped rail 85 engages a flange 62A corresponding to the leg 62 in the preceding embodiment when it is desired to draw a plurality of panels one after the other out of the pocket construction. The remainder of the panel construction is identical to that described hereinabove.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination with a window unit mounted in a building structure having upright walls, said window unit including a window frame and glass panel means mounted in said window frame, the improvement comprising a shutter unit having first and second parallel track means spaced inwardly of said window unit and having a spacing therebetween at least equal to one dimension of said window unit, said track means extending parallel to the plane of said glass panel means;

laminate insulative shield means mounted in said track means for movement between positions adjacent the side of said window unit and in front thereof, to block off the entirety of said glass panel means, low friction means for supporting said laminate insulative shield means for movement on said track means, said laminate insulative shield means including a frame movably supported on said track means and having an imperforate surface layer and an insulation material layer mounted side-by-side in the frame, said imperforate surface including a metallic sheet against which is engaged said insulative material, said insulative material having little resistance against breakage when forces are applied in directions perpendicular to the plane thereof, said metallic sheet providing a protective barrier from the outside and a rigidification of said insulative material against the effects caused by forces applied from the outside in directions perpendicular to the plane thereof; and seal means for effecting a seal around the periphery of said glass panel means and between said window unit and said insulative shield means thereby defining a sealed chamber.

2. The shutter unit according to claim 1, including cam means for preventing removal of said laminate insulative shield means from said track means when in said position in front of said glass panel means; and locking means for fixedly locating said laminate insulative shield means on said track means at least in said position in front of said glass panel means.

3. The shutter unit according to claim 1, wherein said insulative material has an R factor in the range of 3.0 to 8.0.

4. The shutter unit according to claim 3, wherein said insulative material includes a polyurethane foam sheet.

5. The shutter unit according to claim 2, wherein said locking means includes at least one hole in said track means and reciprocal pin means mounted on said laminate insulative shield means receivable in said hole to fixedly locate said laminate insulative shield means on said track means.

6. The shutter unit according to claim 1, wherein said low friction means includes at least a pair of spaced rollers.

7. The shutter unit according to claim 1, wherein said track means includes a track frame adapted for assembly into the interior of a building wall and at the inside of said window unit so that said laminate insulative shield means will be concealed within the wall structure of said building when in the position at the side of said window unit.

8. The shutter unit according to claim 1, wherein said track means includes a track frame and mounting means for securing said track frame to an internal inwardly facing wall surface of said building inside of and surrounding said window unit.

9. In combination with a window unit mounted in a building structure having upright walls, said window unit including a window frame and glass panel means mounted in said window frame, the improvement comprising a shutter unit having track means spaced inwardly of and parallel to the plane of said glass panel means;

laminate insulative shield means mounted in said track means for movement between positions adjacent the side of said window unit and in front thereof, to block off the entirety of said glass panel means, low friction means for supporting said laminate insulative shield means for movement on said track means, said laminate insulative shield means including a frame movably supported on said track means and having an imperforate surface layer and an insulation material layer mounted side-by-side in the frame, said imperforate surface layer providing a surface against which is engaged said insulative material, said insulative material having little resistance against breakage when forces are applied in directions perpendicular to the plane thereof, said imperforate surface layer providing a protective barrier from the outside and a rigidification of said insulative material against the effects caused by forces applied from the outside in directions perpendicular to the plane thereof; and seal means for effecting a seal around the periphery of said glass panel means and between said window unit and said insulative shield means thereby defining a sealed chamber.

10. In combination with a window unit mounted in a building structure having upright walls, said window unit including a window frame and glass panel means mounted in said window frame, the improvement comprising a shutter unit having track means spaced inwardly of and parallel to the plane of said glass panel means;

laminate insulative shield means mounted in said track means for movement between positions adjacent the side of said window unit and in front thereof, to block off the entirety of said glass panel means, low friction means for supporting said laminate insulative shield means for movement on said track means, said laminate insulative shield means including a frame movably supported on said track means and having a rigidifying means and an insulation material layer mounted in said frame, said insulative material having little resistance against breakage when forces are applied in directions perpendicular to the plane thereof, said rigidifying means providing a rigidification of said insulative material against the effects caused by forces applied from the outside in directions perpendicular to the plane thereof; and seal means for effecting a seal around the periphery of said glass panel means and between said window unit and said insulative shield means thereby defining a sealed chamber.

* * * * *